US005772562A

United States Patent [19]

Stevens

[11] Patent Number: 5,772,562

[45] Date of Patent: Jun. 30, 1998

[54] ABDOMINAL EXERCISE APPARATUS

[76] Inventor: Clive Graham Stevens, 372 Hills Borough Road, Auckland, New Zealand

[21] Appl. No.: 653,796

[22] Filed: May 28, 1996

[51] Int. Cl.[6] ..... A63B 23/02

[52] U.S. Cl. ..... 482/140; 482/132; 482/142

[58] Field of Search ..... 482/78, 92, 45, 482/115, 131–133, 139–142, 148, 908; 601/23, 24, 33–35; D21/191, 193

[56] References Cited

U.S. PATENT DOCUMENTS

| | | | |
|---|---|---|---|
| D. 224,422 | 7/1972 | Beach | 482/142 |
| 2,240,228 | 4/1941 | Schall | 482/140 |
| 3,767,190 | 10/1973 | Biggerstaff | 482/142 |
| 5,125,650 | 6/1992 | Paris | 482/142 |
| 5,346,447 | 9/1994 | Stearns | 482/95 |
| 5,492,518 | 2/1996 | Meason | 482/142 |
| 5,529,557 | 6/1996 | Barton | 482/112 |
| 5,567,202 | 10/1996 | Hager | 482/140 |

*Primary Examiner*—Jeanne M. Clark
*Attorney, Agent, or Firm*—Herbert L. Bello

[57] ABSTRACT

An exercise apparatus includes a base, a substantially U-shaped member, and a substantially U-shaped handle element. The base can be configured as pair of individual foot members. The U-shaped member and handle element are pivotally connected to the base at different positions. A head rest is connected to the U-shaped member at a position intermediate the ends thereof. The pivotal connections can include a resistance producing element. A linking member is pivotally connected to each side of the U-shaped member and the U-shaped handle element. Adjacent sides of said U-shaped member and U-shaped handle are connected by the linking member. The position of the linking member can be adjusted as necessary in order to alter the angular disposition of the U-shaped member relative to the U-shaped handle element.

19 Claims, 6 Drawing Sheets

ABDOMINAL EXERCISE APPARATUS

BACKGROUND OF THE INVENTION

1. Field of the Invention

The present invention relates to an exercise apparatus. More particularly, the present invention is directed to an exercise apparatus for the conditioning of muscle groups of the abdomen.

2. Description of the Prior Art

The conditioning of muscle tissue for cosmetic or rehabilitory purposes is a primary focus of most exercise regimens. In order to selectively tone individual muscle groups, individuals employ a variety of exercise activities. Some of these activities require that the muscle group be made to work against an external resistive force. Other exercises center on repeated actuation of muscle groups. In this later type of exercise, muscle strength and tone is gradually improved by repeatedly contracting and relaxing muscle fibers under aerobic and anaerobic conditions.

Several types of apparatuses have been developed to assist in the performance of exercises. Of these devices, multipurpose apparatuses account for a significant portion of the market. The use of these devices is preferred as they can provide a continuous, steady work-out at a convenient location, for example, at home or an exercise facility. Compact exercisers that can be easily folded into a relatively flat storage position because they can be easily stored in relatively small spaces.

One type of abdominal exerciser, shown in U.S. Pat. No. 5,492,520, has a fixed frame with rocker portions. In this type exerciser, the user rolls forward and curls his/her body. Fixed frame exercisers suffer from the limitation that they can not be folded into a relatively flat configuration for storage.

A need has arisen for an exercise device which does not suffer from the heretofore mentioned disadvantages and limitations.

SUMMARY OF THE INVENTION

It is an object of the present invention to provide an exercise apparatus that does not suffer from the foregoing disadvantages and limitations.

It is another object of the present invention to provide an exercise apparatus useful in connection with the performance of abdominal exercises.

It is yet another object of the present invention to provide an exercise apparatus that can be folded flat for storage.

It is a further object of the present invention to provide an exercise apparatus incorporating pivoting members that can be adjusted to require selectable levels of work during the performance of repetition-type abdominal exercises.

It is a still further object of the present invention to provide an exercise apparatus that can be efficiently and economically manufactured.

The exercise apparatus of the present invention is characterized by a base element, a U-shaped member, and a handle element. As discussed in greater detail below, the U-shaped member and handle element are pivotally connected to the base element at different locations. A linking member is pivotally connected to the U-shaped member and the handle element. If desired, a resistance producing element can be incorporated into the pivotal connections between the U-shaped member, handle element, and base element.

The base element is configured to supportingly and pivotally receive both the U-shaped member and handle element. The base element typically has a first end and a second end. If desired, the base element can be a single, laterally extending, flange. Alternatively, the base element can be configured as a pair of feet forming two, that is, first and second, supports. In this later configuration, each support is designed to receive the ends of the U-shaped member and handle element in the manner described below.

The U-shaped member has a first end and a second end, each of which is pivotally connected to an opposite end the base element. Structurally, the first end of the U-shaped member is typically connected to the first end of the base element while the second end of the U-shaped member is connected to the second end of the base element. In the preferred embodiment of the invention, a head rest disposed intermediate the ends of the U-shaped member.

The handle element is also pivotally connected to the base element at a point that is different from the pivot connection of the base element. Separation of the pivotal attachment points is desired as it serves to increase the mechanical advantage of the individual components during operation of the apparatus of the invention.

The handle element can have a. U-shaped configuration with first and second ends. The first end of the U-shaped handle element is connected to the first end of the base element while the second end of the U-shaped handle element is connected to the second end of the base element. The handle element preferably includes an arm rest that is sized and shaped to provide a support for the upper and lower arm of individuals using the apparatus of the invention. By supporting an individual's arm during operation of the apparatus of the invention, the muscle groups of the arm and shoulder are isolated and, thus, exercise activity is focused on the muscle groups of the abdomen.

A pair of linking member elements are connected at each side of the base element to both the U-shaped member and the handle element. More particularly, each linking member element has a first end which is connectable to the U-shaped member and a second end which is connectable to the handle element. In one embodiment the linking member elements are pivotally connected to both the U-shaped member and the handle element at fixed locations. In an alternative embodiment, the linking member pivot connections are configured so that one or both of the ends of the linking member can be moved along a portion of the length of either or both of the U-shaped member and handle element. By adjusting the relative position of the linking member element on the U-shaped member and handle element, the angular disposition of these components can be adjusted. This adjustment permits an individual to increase or decrease the amount of work necessary to perform a series of abdominal exercises.

To utilize the apparatus of the invention, the U-shaped member and handle element are pivoted from a typically collapsed, stored condition to an extended, operational position. More particularly, these components are pivoted until they can be interconnected by the linking member element. The relative angular disposition at which these elements are fixed for exercise is selected based on the exercise needs of a particular individual. Next, the resistance elements are adjusted so as to provide the desired level of resistance to the movement of the U-shaped member and handle element. Once fully assembled, an individual positions their upper body above, and in juxtaposition to, the U-shaped member. When properly positioned in the apparatus of the invention, the individual's head rests on the head rest of the U-shaped member. The individual then grasps the handle element, placing their arm into the arm rest of the handle element, and pushes the handle element forward. The user bends at the waist or curls as he/she moves to a somewhat sitting position.

To effectively use the apparatus of the invention, an individual bends only at the waist during performance of an abdominal exercise. To maximize the exercise performed by abdominal muscle groups, only minimal force is applied by the arms against the handle element. More particularly, by minimizing the work performed by the muscle groups of the arms and shoulders, the abdominal muscles are forced to perform virtually all of the work necessary to raise an individual's upper body during performance of, for example, a sit-up exercise. Of course, if desired, the amount of work performed by the muscle groups of the arms and abdomen can be adjusted by increasing the use of the arms during a given exercise session.

To begin an abdominal exercise, an individual starts in a relaxed face-up position. Typically, the individual is prone on a flat, i.e., floor, surface. The individual then concurrently presses lightly on the handle element while bending at the waist to lift their upper body. This action requires the individual to employ, to the degree desired, muscles of both the arms, shoulders, and abdomen in order to raise their upper body from the floor surface. Slow, upward movement continues until the upper body of the individual is at an angle of at least thirty degrees relative to the lower body, the user's head being supported on the head rest. The user holds this position for as long, or short, a period as desired. Next, the individual slowly returns to the prone position by relaxing the muscle groups of the arms, shoulders, and abdomen as necessary. This cycle of upward and downward movement is repeated as fast, and frequently, as necessary in order to provide the desired level of exercise for the muscles of an individual.

Other general and specific objects of the invention will in part be obvious and will in part appear hereinafter.

The invention accordingly comprises the steps and apparatus embodying features of construction, combinations of elements and arrangements of parts adapted to effect such steps, as exemplified in the following detailed disclosure, and the scope of the invention is indicated in the claims.

BRIEF DESCRIPTION OF THE DRAWINGS

A fuller understanding of the nature and objects of the present invention will become apparent upon consideration of the following detailed description taken in connection with the accompanying drawings, wherein.

DESCRIPTION OF PREFERRED EMBODIMENTS

Figure 1:
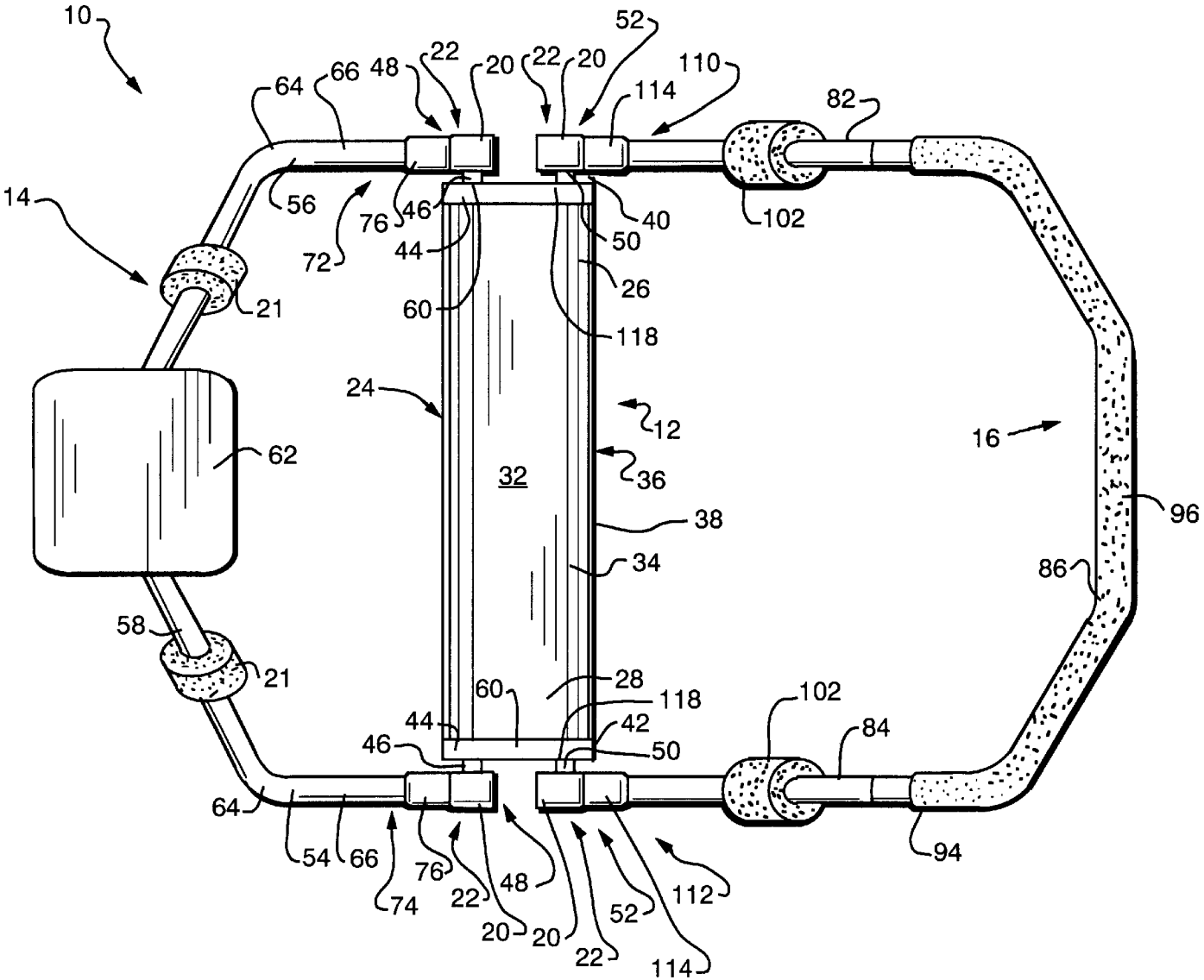
FIG. 1 is a top, plan view of one embodiment of the exercise apparatus of the invention.

The invention features an exercise apparatus that, when properly utilized, provides a safe and efficient means for the exercise of those muscle groups of the upper body and, in particular, the abdomen.

Referring to FIGS. 1 through 6, wherein like reference numerals refer to like parts, there is illustrated an exercise apparatus 10 embodying the present invention. The exercise apparatus 10 generally includes a base element 12, a U-shaped member 14, a handle element 16, and a linking member 18. As discussed in greater detail below, the U-shaped member 14 and handle element 16 are pivotally connected to the base element 12 at different locations. The linking member 18 interconnects the U-shaped member 14 and handle element 16. If desired, a resistance producing element 20 can be incorporated into the pivotal connections 22 between the U-shaped member 14, handle element 16, and base element 12. In an alternative embodiment, weights 21 are positioned on U-shaped member 14 to provide added resistance. Although all of these components are depicted in rectangular and tubular configurations, as applicable, in the several FIGURES, those skilled-in-the-art will appreciate that they can be sized and shaped as desired providing they have the requisite mechanical strength and configuration to permit proper operation of exercise apparatus 10.

Figure 4:
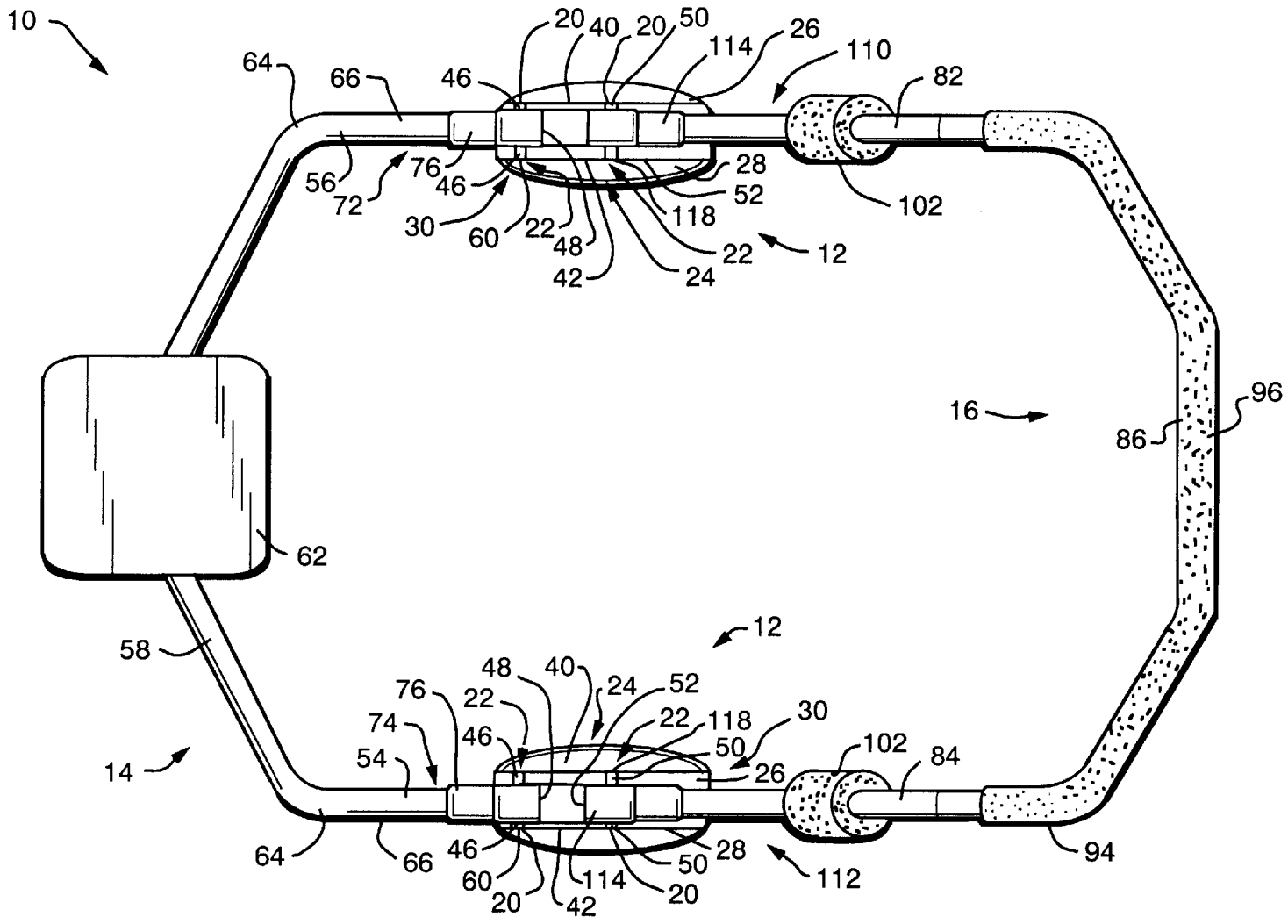
FIG. 4 is a top, plan view of an alternative embodiment of the exercise apparatus of the invention.

The base element 12 is configured to supportingly and pivotally receive both the U-shaped member 14 and the handle element 16. As shown in FIGS. 1 and 4, the base element 12 generally is a platform 24 having a first end 26 and a second end 28. In the configuration shown in FIG. 1, the base element 12 is formed from a single, laterally extending platform 24. In an alternative embodiment shown in FIG. 4 and discussed later, the base element 12 is a pair of supports 30. An upper, exposed surface 32 of the base element 12 can include a pad or other cushioning material 34. An obverse surface 36 of the base element 12 is in contact with the floor or other surface upon which the apparatus 10 is positioned for use. Typically, the surface 36 is covered with a material 38 that is in frictional engagement with a support surface or floor upon which the apparatus 10 is positioned. In operation, the material 38 frictionally engages the support surface so that the apparatus 10 remains stationary during use.

In the configuration of the base element 12 depicted in FIG. 1, the platform 24 is formed from a single laterally extending member. The platform 24 typically has a first dimension sufficient to permit passage of an individual using the apparatus 10 in the manner described below. In addition, the platform 24 has a second dimension sufficient to supportingly receive the operational components of the apparatus 10 described in detail below while providing the necessary mechanical strength required for operation of the exercise apparatus. Flanges 40, 42 rise substantially perpendicularly from the platform 24 at both the first end 26 and second end 28 thereof. More particularly, flange 40 extends from the first end 26 of the platform and flange 42 extends from the second end 28 of the platform 24. Reinforcing elements 44 are juxtaposed to each of the flanges 40 and 42. The reinforcing elements 44 are in substantially surface-to-surface contact with each of the flanges 40 and 42. In operation, the reinforcing elements 44, augment the mechanical strength of the flanges 40 and 42.

The U-shaped member 14 and handle element 16 are connected to the platform 24 via flanges 40 and 42. More particularly, coaxially positioned in the flanges 40 and 42 are a first set of apertures 46. The apertures 46 are sized and shaped to receive systems 48 which connect the base element 12 to the U-shaped member 14. Also coaxially positioned in the flanges 40 and 42 are a second set of apertures 50. Each of the apertures 50 are at a location distinct from, but proximal to, the apertures 46. The apertures 50 are configured to receive systems 52 which connect the base element 12 to the handle element 16.

An alternative configuration for the base element 12 is depicted in FIG. 4. In the embodiment of the invention shown in FIG. 4, the base element 12 is formed from a pair of supports 30. The supports 30 are sufficiently wide to receive the U-shaped member 14 and handle element 16. If required, additional space can be added in order to accommodate the resistive elements 20, if any, described in detail below. Each of the supports 30 have a platform 24. A flange rises at each of the first and second ends 26 and 28 of the platforms 24 of each of the supports 30. More particularly, extending from the first end 26 of each of the platforms 24 is a raised flange 40. A flange 42 rises from the second end 28 of each of the platforms 24. The supports 30 are spaced apart a sufficient distance to permit a user lying on his back to fit therebetween.

The U-shaped member 14 and handle element 16 are connected to each of the supports 30 via the flanges 40 and 42. More particularly, coaxially positioned in the flanges 40 and 42 of each support 30 are a first set of apertures 46. The apertures 46 are sized and shaped to receive systems 48 which connect the base element 12 to the U-shaped member 14. Also coaxially positioned in the flanges 40 and 42 of each of the supports 30 are a second set of apertures 50. Each of the apertures 50 are at a location distinct from, but proximal to, the apertures 46. The apertures 50 are configured to receive systems 52 which connect the base element 12 to the handle element 16.

As shown in the several FIGURES, the U-shaped member 14 is formed from a pair of legs 54, 56 and a cross member 58. The legs 54, 56 and cross member 58 are of sufficient size so as to possess the requisite mechanical strength. In the preferred embodiment, the legs 54, 56 and cross member 58 are formed from a continuous, axially extending tubular substrate. In the illustrated embodiment, the legs 54, 56 and cross member 58 are shown as separate components that are secured together using a pin, bolt, or other fastener 60. The U-shaped member 14 can be manufactured from virtually any strong durable material, such as aluminum, steel, or polymeric composites, preferably, aluminum tubing.

The cross member 58 extends between the legs 54 and 56. Centrally located, and integral with, the cross member 58 is a head rest element 62. The head rest element 62 can have virtually any configuration providing it can support the head of user during an exercise period. In the preferred embodiment of the apparatus of the invention 10 as shown in the several FIGURES, the head rest element 62 has a substantially rectangular configuration. In an alternative embodiment of the apparatus of the invention 10, the head rest element 62 can have an annular configuration. In this later configuration, to position the head rest 62 on the cross member 58, the cross member 58 is first inserted through the central aperture in the head rest element 62. The head rest element 62 is then slid on and along the cross member 58 until properly positioned and secured in place.

Each of the legs 54 and 56 include an upper portion 64 and a lower portion 66. The upper portions 64 are connected to the cross member 58. The lower portions 66 provide the desired pivotal connection 22 between the U-shaped member 14 and the base element 12. In addition, the lower portions 66 provide a connection point for the linking member 18. More particularly, located along an longitudinally axis of the lower portions 66 are a series of apertures 68 configured to removably and replaceably receive a pin, bolt, or other fastener 70 which pivotally connects the U-shaped member 14 to the handle element 16. The lower portions 66 also define a first end 72 and a second end 74 for the U-shaped member 14. Affixed at each of the first and second ends 72 and 74 is a connector element 76 which forms the connection system 48. Each of the connector elements 76 includes an aperture 78 sized to receive a pin, bolt or other fastener 60 which, in operation, pivotally connects the U-shaped member 14 to the base element 12. When fully assembled, the apertures 78 of the connector element 76 are coaxial with the apertures 46 in the base element 12. To secure the base element 12 and U-shaped member 14 together, the fastener 60 is thrust through the apertures 46 and 80 and then secured in position. If desired, the connection system 48 can also include a washer or bushing that, in operation, functions as a resistance producing element 20.

Cooperating with the U-shaped member 14 to assist in the performance of abdominal exercises is the handle element 16. As those skilled-in-the-art will appreciate, the handle element 16 can have virtually any configuration providing it satisfies the need for a surface against which an individual can press during performance of an abdominal exercise. Accordingly, in one embodiment of the apparatus of the invention 10, the handle element 16 is an axially extending member incorporating a hand hold. In the preferred embodiment of the apparatus of the invention 10 as shown in the several FIGURES, however, the handle element 16 typically has a U-shaped configuration. More particularly, as best shown in FIGS. 1 and 4, the handle element 16 is formed from a pair of legs 82, 84 and a cross member 86. The legs 82, 84 and cross member 86 are of sufficient size so as to possess the requisite mechanical strength. Typically, the legs 82, 84 and cross member 86 are formed from a continuous, axially extending tubular substrate. The handle element 16 can be manufactured from virtually any strong durable material, such as aluminum, steel, or polymeric composites, preferably, aluminum tubing.

Each of the legs 82 and 84 include an upper portion 88, an intermediate portion 90, and a lower portion 92. The upper portions 88 are connected to the cross member 86. If desired, the upper portions 88 can be covered at least partially by a sleeve 94 composed of, for example, plastic or rubber. When utilized, the sleeve 94 is typically continuous a similarly composed sleeve 96 which extends over the cross member 86. A bend 98 connects the upper portions 88 to the intermediate portions 90. The bend 98 typically has an angle of about ninety degrees.

Typically, the intermediate portion 90 is sized and shaped so as to form an arm rest element 100. Generally, the arm rest element 100 is sized and shaped to provide a support for the upper and lower arm of individuals using the apparatus of the invention 10. By supporting an individual's arm during operation of the apparatus of the invention 10, the muscle groups of the arm are isolated and, thus, exercise activity is focused on the muscle groups of the abdomen. Preferably, the arm rest element 100 of the intermediate portion 90 is covered by a resilient material 102 which acts as a cushion during use of the apparatus of the invention 10. A bend 104 connects the intermediate portion 90 to the lower portion 92. Generally, the bend 104 has an angle of about ninety degrees.

The lower portions 92 provide the desired pivotal connection points 22 between the handle element 16 and the base element 12. In addition, the lower portions 92 provide a connection point for the linking member 18. More particularly, those sections of the lower portions 92 that are proximate to the intermediate portions 90 include a series of apertures 106 configured to removably and replaceably receive a pin, bolt, or other fastener 108 which pivotally connects the handle element 16 to the linking member 18. The distal end of the lower portions 92 define a first end 110 and a second end 112 for the handle element 16. Affixed at each of the first and second ends 110 and 112 is a connector system 52. Each of the connector systems 52 include a connector element 114 having an aperture 116 that is sized to receive a pin, bolt or other fastener 118 which, in operation, pivotally connects the handle element 16 to the base element 12. When fully assembled, the apertures 116 of the connector element 114 are coaxial with the apertures 50 in the base element 12. To secure the base element 12 and handle element 16 together, the fastener 118 is thrust through the apertures 50 and 116 and secured in position. If desired, the connector element 114 can also include a washer or bushing that, in operation, functions as a resistance producing element 20.

The linking member 18 interconnects the U-shaped member 14 to the handle element 16. Typically, the linking member 18 is configured as a rectilinear flange 120. The flange 120 has a first end 122 and a second end 124. An aperture 126 is typically positioned in close proximity to the terminus of the first end 122. The aperture 126 is preferably sized and shaped to receive a pin, bolt, or other fastener 108 that is capable of pivotally connecting the linking member 18 to the handle member 16. A second aperture 128 is located close to the terminus of the second end 124. The aperture 128 is also configured to receive a pin, bolt, or other fastener 70. Typically, the fastener 70 is designed to be removably and replaceably positionable in one of the apertures 68 in the lower portion 66 of the U-shaped member 14. The linking member 18 can be manufactured from virtually any strong durable material, such as aluminum, steel, or polymeric composites, preferably, aluminum tubing.

Figure 2:
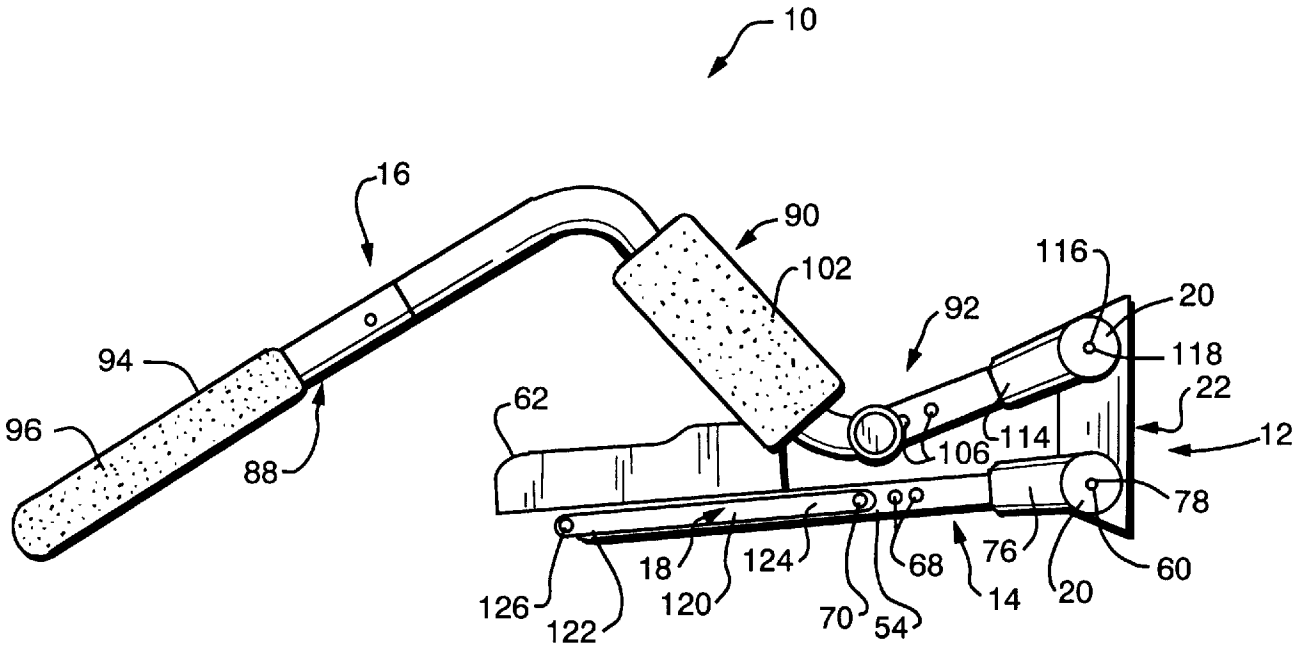
FIG. 2 is a side view of the embodiment of the invention shown in FIG. 1 in a collapsed, stored configuration.
Figure 3:
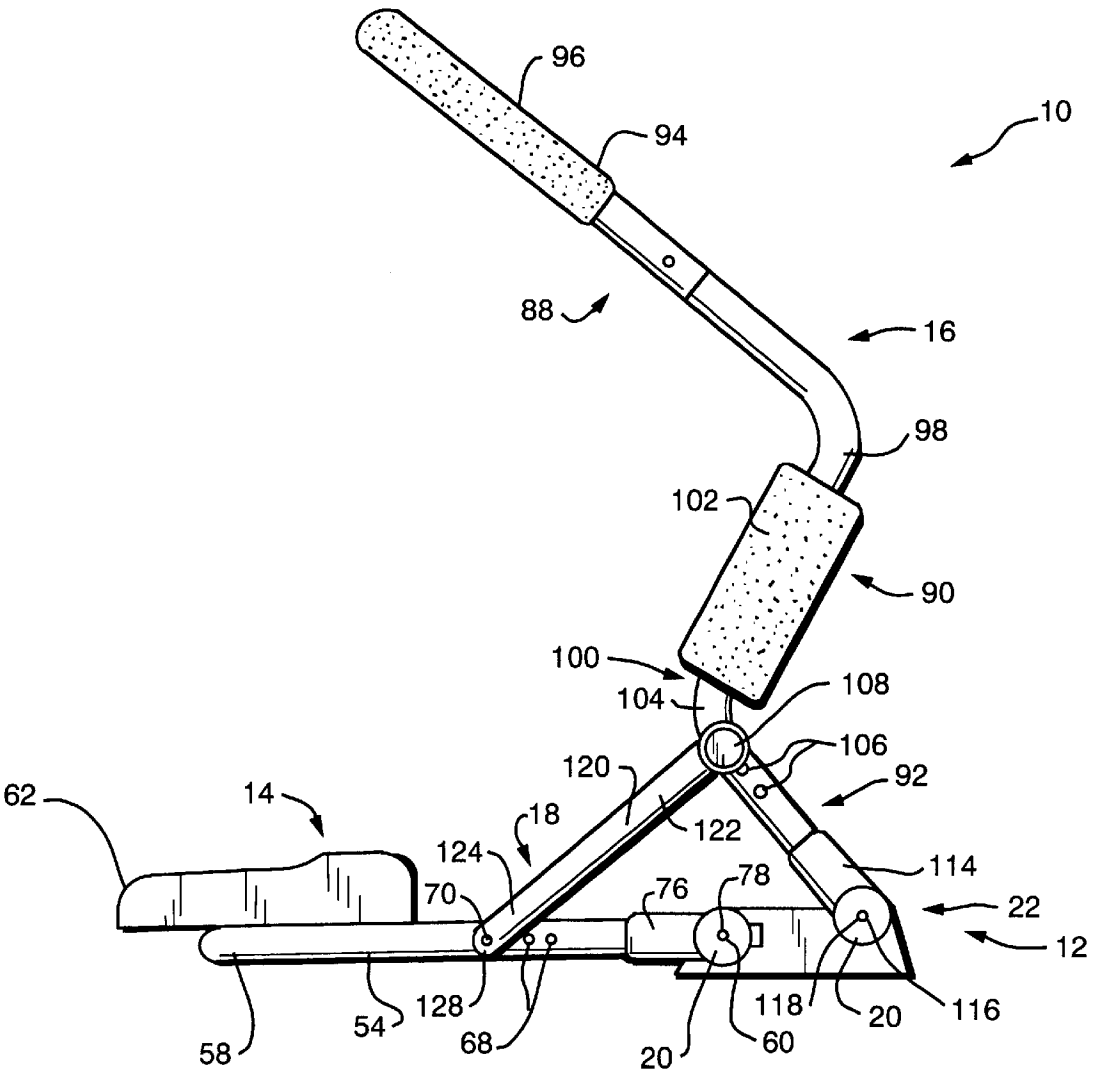
FIG. 3 is a side view of the embodiment of the invention shown in FIG. 1 in an extended, operational configuration.
Figure 5:
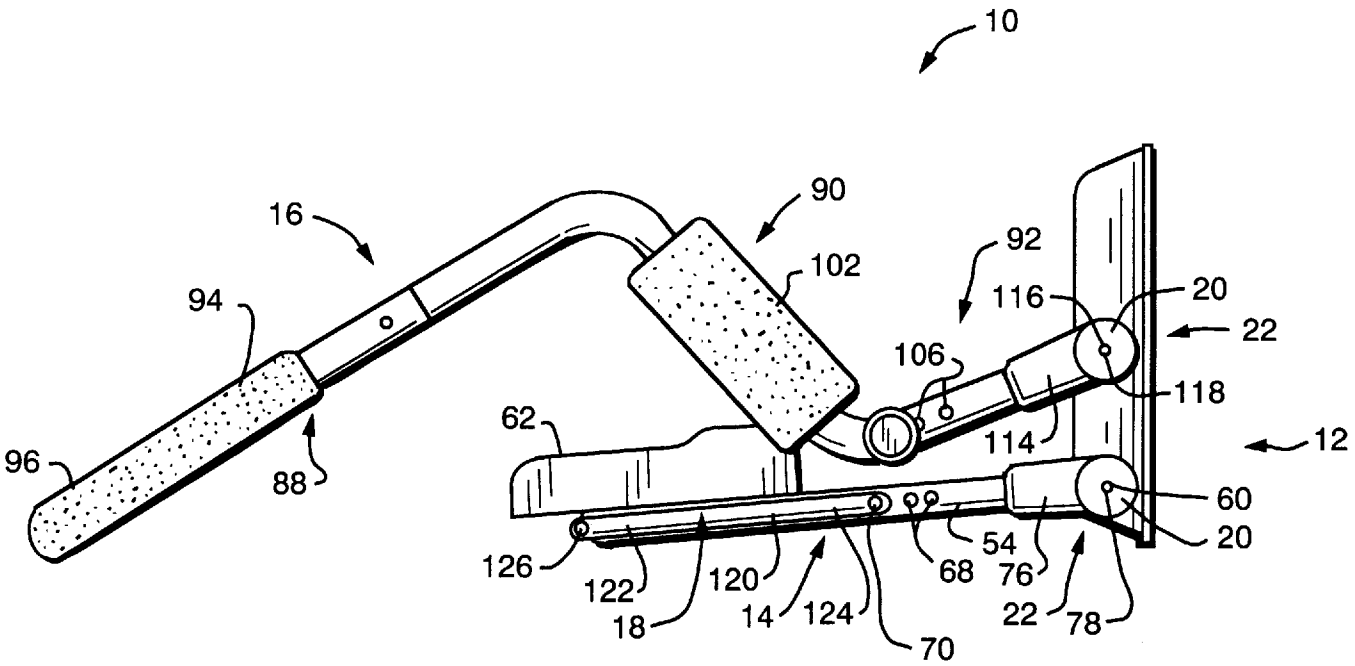
FIG. 5 is a side view of the embodiment of the invention shown in FIG. 4 in a collapsed, stored configuration; and, FIG. 6 is a side view of the embodiment of the invention shown in FIG. 4 in an extended, operational configuration.
Figure 6:
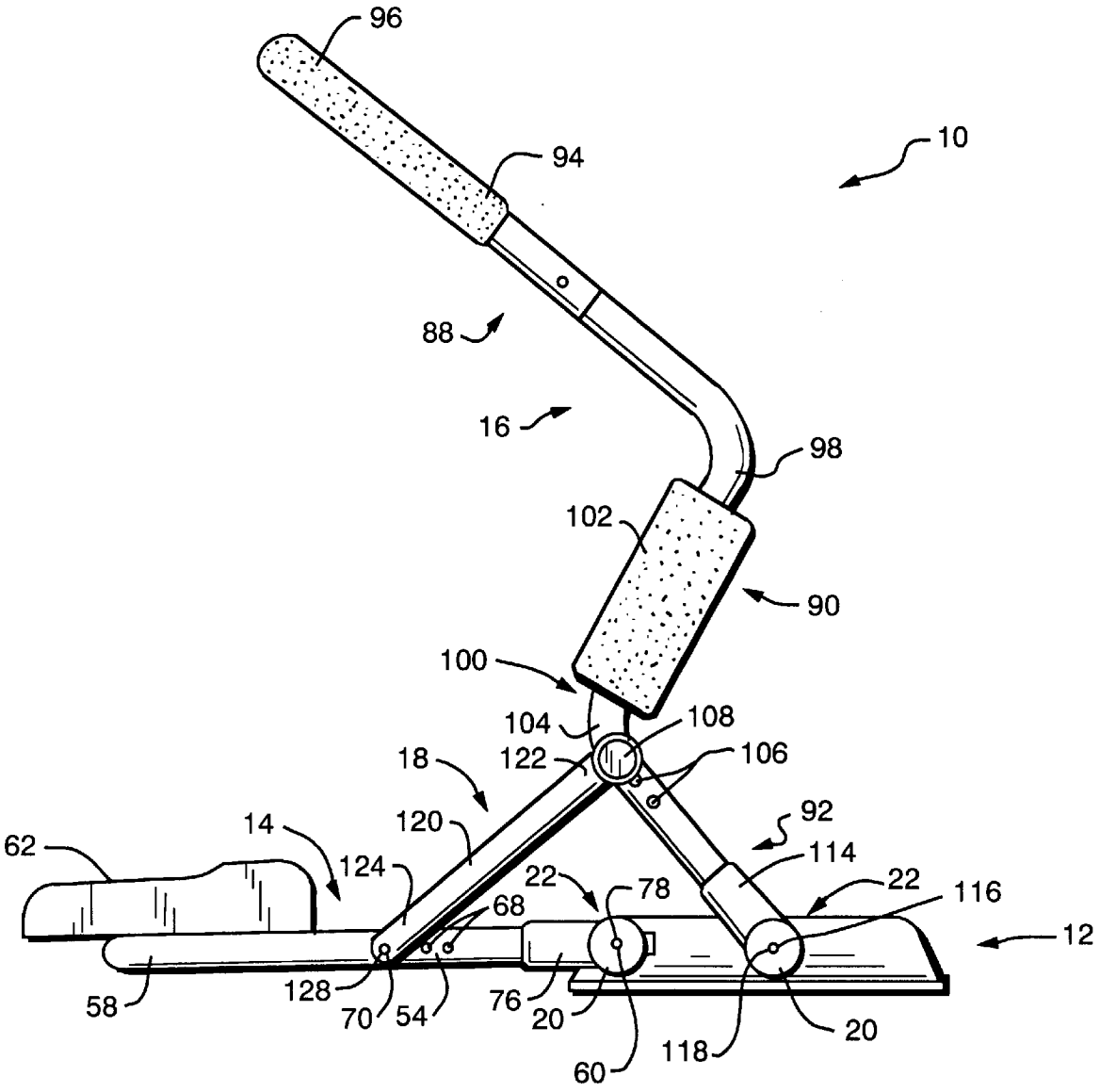

To utilize the apparatus of the invention, the U-shaped member 14 and handle element 16 are pivoted from a typically collapsed or stored position, as shown in FIGS. 2 and 5, to an extended, operational position, as shown in FIGS. 3 and 6. More particularly, these components are pivoted until they can be interconnected by the linking member 18. The relative angular disposition at which the U-shaped member 14 and handle element 16 are fixed for exercise is selected based on the exercise needs of a particular individual. Next, the resistance producing elements 20 are adjusted so as to provide the desired level of resistance to the movement of the U-shaped member 14 and handle element 16. Once fully assembled, for example as shown in FIGS. 3 and 6, an individual positions his/her upper body above and in juxtaposition to the U-shaped member 14. When properly positioned in the exercise apparatus 10, the individual's head rests on the head rest element 62 of the U-shaped member 14. The individual then grasps the handle element 16 placing his/her arm into the arm rest element 100 of the handle element 16.

To effectively use the exercise apparatus 10, an individual bends only at the waist during performance of a given abdominal exercise. To maximize the exercise performed by abdominal muscle groups, only minimal force is applied by the arms against the handle element 16. More particularly, by minimizing the work performed by the muscle groups of the arms and shoulders, the abdominal muscles are forced to perform virtually all of the work necessary to raise an individual's upper body during performance of, for example, a sit-up exercise. Of course, the amount of work performed by the muscle groups of the arms and abdomen can be adjusted by increasing the use of the arms during a given exercise session.

To begin an abdominal exercise, an individual starts in a relaxed, face-up, position. Typically, the individual is supine on a flat, i.e., floor, surface. The individual then concurrently presses on the handle element 16 while bending at the waist to lift his/her upper body. This action requires the individual to employ, to the degree desired, muscles of both the arms, shoulders, and abdomen in order to raise their upper body from the floor surface. Slow, upward movement continues until the upper body of the individual is at an angle of at least thirty degrees relative to the lower body. The user holds this position for as long, or short, a period as desired. Next, the individual slowly returns to the supine position by relaxing the muscle groups of the arms, shoulders, and abdomen as necessary. This cycle of upward and downward movement is repeated as fast, and frequently, as necessary in order to provide the desired level of exercise for the muscles of an individual.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

Having described the invention, what is claimed as new and secured by letters patent is:

1. An exercise apparatus, said apparatus comprising:

(a) a base means, said base means configured to be directly supported on a support surface, said base means having a first end and a second end;

(b) a U-shaped member, said U-shaped member having a first end and a second end, said first end of said U-shaped member being pivotally connected to said first end of said base means, said second end of said U-shaped member being pivotally connected to said second end of said base means;

(c) a handle means, said handle means being pivotally connected to said base means, said pivotal connection of said handle means to said base means being located at a position different from either said pivotal connection of said first end of said U-shaped member and said base means or said pivotal connection of said second end of said U-shaped member and said base means; and, (d) a linking member means, said linking member means having a first end and a second end, said first end of said linking member means being pivotally connected to said U-shaped member, said second end of said linking member means being pivotally connected to said handle means, said linking means holding said handle means at an angular position relative to said U-shaped member, said interconnected U-shaped handle means and said U-shaped member means move relative to said base means during use of the exercise apparatus.

2. The apparatus of claim 1 including a head rest means operatively connected to said U-shaped member, said head rest means disposed intermediate said first and second ends of said U-shaped member.

3. The apparatus of claim 1 including resistance means connected at said selected ones of said pivot connections of said base means and said U-shaped member and said handle means.

4. The apparatus of claim 3 wherein said resistance means of said pivotal connections of said U-shaped member are adjustable.

5. The apparatus of claim 1 including an arm rest means connected to said handle means.

6. The apparatus of claim 1 wherein one of said first and second end of said linking member means is removeably and replaceably connected to one of said handle means, said U-shaped member, and the other of said first and second end of the other of said linking member means is removeably and replaceably connected to the other of said handle means and said U-shaped member so as to permit adjustment of the angular disposition of said U-shaped member relative to said handle means.

7. The apparatus of claim 1 wherein said base means includes a first base support and a second base support, said first base support configured to supportingly and pivotally receive said first end of said U-shaped member at a first location and a first end of said handle means at a second location, said second base support configured to supportingly and pivotally receive said second end of said U-shaped member at a third location and a second end of said handle means at a fourth location, said first, second, third, and fourth locations being different locations.

8. An exercise apparatus, said apparatus comprising:

(a) a base means, said base means configured to be directly supported on a support surface, said base means having a first end and a second end;

(b) a U-shaped member, said U-shaped member having a first end and a second end, said first end of said U-shaped member being pivotally connected to said first end of said base means at a first location, said second end of said U-shaped member being pivotally connected to said second end of said base means at a second location;

(c) a U-shaped handle means, said U-shaped handle means having a first end and a second end, said first end of said U-shaped handle means being pivotally connected to said first end of said base means at a third location which is spaced from said first location, said second end of said U-shaped handle means being pivotally connected to said second end of said base means at a fourth location which is spaced from said second location; and, (d) a linking member means, said linking member means having a first end and a second end, said first end being operatively connected to said U-shaped member for pivoting movement relative thereto, said second end being operatively connected to said U-shaped handle means for pivoting movement relative thereto, said linking means holding said U-shaped handle means at an angular position relative to said U-shaped member, said interconnected U-shaped handle means and said U-shaped member means move relative to said base means during use of the exercise apparatus.

9. The apparatus of claim 8 including a head rest means operatively connected to said U-shaped member and positioned intermediate said first and second ends of said U-shaped member.

10. The apparatus of claim 8 including resistance means at selected ones of said pivotal connections of said U-shaped member and said handle means to said base means.

11. The apparatus of claim 10 wherein said resistance means of said pivotal connections are adjustable resistance means.

12. The apparatus of claim 8 including an arm rest operatively connected to U-shaped handle means.

13. The apparatus of claim 8 wherein said first end of said linking member means is removably and replaceably connected to said U-shaped member and said second end of said linking member means is removably and replaceably connected to said U-shaped handle means so as to permit adjustment of the angular disposition of said U-shaped member relative to said U-shaped handle means.

14. The apparatus of claim 8 including resistance means operatively connected at each of said pivotal connections of said U-shaped handle means to said base means.

15. The apparatus of claim 14 wherein said resistance means of said pivotal connection of said U-shaped handle means are adjustable resistance means.

16. An exercise apparatus, said apparatus comprising:

(a) a base means, said base means configured to be directly supported on a support surface, said base means having a first base support and a second base support, said first and second base supports spaced apart;

(b) a U-shaped member, said U-shaped member having a first end and a second end, said first end of said U-shaped member being pivotally connected to said first base support at a first location, said second end of said U-shaped member being pivotally connected to said second base support at a second location;

(c) a U-shaped handle means having a first end and a second end, said first end of said U-shaped handle means being pivotally connected to said first base support at a third location which is spaced from said first location, said second end of said U-shaped handle means being pivotally connected to said second base support at a fourth location which is spaced from said second location; and, (d) a linking member means having a first end and a second end, said first end being operatively connected to said U-shaped member for pivoting movement relative thereto, said second end being operatively connected to said U-shaped handle means for pivoting movement relative thereto, said linking means holding said handle means at an angular position relative to said U-shaped member, said interconnected U-shaped handle means and said U-shaped member means move relative to said base means during use of the exercise apparatus.

17. The apparatus of claim 16 including a head rest means operatively connected to said U-shaped member, said head rest means disposed intermediate said first and second ends of said U-shaped member.

18. The apparatus of claim 16 including an arm rest operatively connected to U-shaped handle means.

19. The apparatus of claim 16 including resistance means operatively connected to said U-shaped member.

* * * * *